US009149123B2

(12) United States Patent
Dennehy

(10) Patent No.: US 9,149,123 B2
(45) Date of Patent: Oct. 6, 2015

(54) CHAIR SEAT PAN AND CHAIR INCORPORATING SAME

(76) Inventor: Simon Dennehy, Kanturk (IE)

( * ) Notice: Subject to any disclaimer, the term of this patent is extended or adjusted under 35 U.S.C. 154(b) by 64 days.

(21) Appl. No.: 12/996,213

(22) PCT Filed: Jun. 5, 2009

(86) PCT No.: PCT/EP2009/056977

§ 371 (c)(1),
(2), (4) Date: Dec. 3, 2010

(87) PCT Pub. No.: WO2009/147249

PCT Pub. Date: Dec. 10, 2009

(65) Prior Publication Data

US 2011/0089740 A1 Apr. 21, 2011

(30) Foreign Application Priority Data

Jun. 6, 2008 (IE) ..... S2008/0458

(51) Int. Cl.
*A47C 7/02* (2006.01)

(52) U.S. Cl.
CPC ..... *A47C 7/022* (2013.01)

(58) Field of Classification Search
CPC ..... A47C 7/022; A47C 7/14; A47C 7/16
USPC ..... 297/452.1, 452.21, 452.46
See application file for complete search history.

(56) References Cited

U.S. PATENT DOCUMENTS

| | | | | |
|---|---|---|---|---|
| 1,813,672 | A | 7/1931 | Mesinger | |
| 3,326,600 | A * | 6/1967 | Mathews | 296/153 |
| 4,718,727 | A | 1/1988 | Sheppard | |
| 5,681,092 | A * | 10/1997 | Hanson et al. | 297/452.41 |
| D460,300 | S * | 7/2002 | Fifield et al. | D6/502 |
| 6,422,650 | B1 * | 7/2002 | Chien-Shen | 297/312 |
| 7,077,469 | B2 * | 7/2006 | Badia i Farre | 297/202 |
| 2007/0057562 | A1 * | 3/2007 | Gregory et al. | 297/452.21 |

FOREIGN PATENT DOCUMENTS

| | | | |
|---|---|---|---|
| DE | 1935147 | U | 3/1966 |
| ES | 2082682 | A2 | 3/1996 |
| GB | 2281541 | A | 3/1995 |
| WO | 00/02470 | A | 1/2000 |
| WO | 02/07567 | A | 1/2002 |

* cited by examiner

*Primary Examiner* — Philip Gabler
(74) *Attorney, Agent, or Firm* — Edwin S. Flores; Daniel J. Chalker; Chalker Flores, LLP

(57) ABSTRACT

A chair seat pan comprising a reinforced rear region, a reinforced pommel region, a pair of forward flexible regions which resiliently flex with respect to the reinforced regions under external pressure, and a continuous upper surface throughout the reinforced rear region, the reinforced pommel region, and the pair of flexible regions, for supporting a user.

28 Claims, 6 Drawing Sheets

702
706
703
704
701

801
802
803
804
805
806

CHAIR SEAT PAN AND CHAIR INCORPORATING SAME

CROSS-REFERENCE TO RELATED APPLICATION

The present invention claims priority 35 U.S.C. §371 to Patent Cooperation Treaty (PCT) Application No. PCT/EP2009/056977 as filed on Jun. 5, 2009.

FIELD OF THE INVENTION

The invention relates to chairs, in particular an ergonomic seat pan for a chair suitable for use with a variety of desk types.

BACKGROUND TO THE INVENTION

Conventional seating arrangements for occupational environments such as offices and schools provide a seating position where an angle of 90° increasing the pressure on the spinal column and resulting in a poor working environment where strain injuries, back pain are increasingly common. Seating which encourages movement and improved posture with a higher sitting position is therefore desirable.

WO 96/10937 discloses a chair seat and a chair made with this chair seat in which a chair seat is divided into several parts, comprising a part being fixed and a pivoting part where the pivoting part may pivot down from a starting position around a crossing axis, against an elastic counter force, enabling a change of the sitting position by having the user change the angle of their hips. This creates a chair seat and chair allowing the user to vary the positions of sitting and at the same time having support when seated with the lower part of the body in different positions.

A drawback with this arrangement is that the slits on the seat means that the users legs are susceptible to a rather inconvenient pinch effect both when sitting on and when getting off the chair. The legs of the subject are not in any way directed apart and to the side of the seat pan making the seat of this invention uncomfortable for the user. In addition, the hinged effect depends on a live hinge for achieving the flexibility required.

In EP1319353 a task chair including seat supporting structure and a seat supported by the seat structure and having a seating surface which may ergonomically conform to a seated user is disclosed. The seating surface includes rigid and flexible portions connected to one another, the flexible portions allowing resilient flexing of the seating surface to create conformance zones which dynamically support a seated user in an ergonomic manner.

However this seat conforms to the seated user rather than encouraging the user to adopt a seating position promoting good posture. Additionally it is only suitable for use in a standard seating position. The seat is manufactured from multiple components such as wood, metal or plastic and the flexible portions formed from pliable urethane or silicon. The portions are connected by insert moulding the flexible portions to the rigid portions or by mechanically or adhesively joining the flexible portions to the rigid portions.

Ergonomically a higher seating position is preferable as it encourages a spinal position similar to that achieved when standing.

WO8301184 discloses a stool with a support means and a flexible sitting surface where the support means comprises a frame with a front part bent to an approximately inverted U-shape and a back frame part being straight or slightly curved. A net is stretched over the pre-bent frame to provide a seat.

Therefore, there is a requirement for a low cost seat manufactured from a single material. In addition, it is also desirable to have a seat, which encourages the user to adopt a seating position which promotes good posture regardless of the desk style.

SUMMARY OF THE INVENTION

Accordingly, the present invention provides a chair seat pan comprising:

- a reinforced rear region,
- a reinforced pommel region,
- a pair of forward flexible regions which resiliently flex with respect to the reinforced regions under external pressure, and
- a continuous upper surface throughout the reinforced rear region, the reinforced pommel region, and the pair of flexible regions, for supporting a user.

By resiliently, it is meant that the forward flexible regions return or spring back to a rest position once the external force is removed. In normal use, the external force is provided by the underside of the thighs or buttocks of a user.

The terms forward and rear correspond to the direction of facing of a user when the seat pan is in use.

The term continuous as used herein means that there are no breaks or splits between the defined regions of the seat pan, in other words the surface is undivided between the regions. The periphery of the seat pan is therefore also continuous and unbroken by slits or cuts. Internal/closed holes, apertures or perforations are possible in the surface without destroying its continuity.

Preferably at least the continuous upper surface is integrally moulded resulting in a single piece of plastics material. Injection moulding or gas-assisted injection moulding processes may be used to manufacture the seat pan. The material used may be a polymer or composite such as polypropylene. In one embodiment the entire seat pan is a one-piece moulded object.

The seat pan may comprise areas of reduced material thickness. Likewise there may be regions of relative increased thickness. Preferably the material thickness of the flexible regions is less than the material thickness of the rear reinforced region.

The term reinforced when used herein is intended to represent that that such regions are more resilient to external forces than the so-called flexible regions. Various means of reinforcing are envisaged by the invention. The reinforcing may be provided externally or maybe provided inherently by the natural or engineered properties of the seat pan in that particular region.

Preferably the reinforced rear region comprises a plurality of reinforcing ribs. Preferably the ribs are located on the underside of the chair seat pan, although in alternative embodiments the ribs may be internal or on the upper side of the seat pan. Ideally however, the ribs are integrally moulded on the underside of the chair seat pan.

Preferably the reinforced pommel region comprises a plurality of reinforcing ribs. Preferably the ribs are located on the underside of the chair seat pan, although in alternative embodiments the ribs may be internal or on the upper side of the seat pan. Ideally however, the pommel ribs are integrally moulded on the underside of the chair seat pan.

In alternative embodiments the reinforcing may be provided by increasing the thickness of the material of the pan in these regions either during manufacturing or post-production. Any other type of reinforcing may alternatively be used.

The chair seat pan may further comprise a peripheral rim. Preferably the rim is of varying thickness. The peripheral rim may alternatively or additionally be of varying cross-sectional shape. Preferably the rim adjacent the flexible regions has a substantially elliptical cross-section. This cross-sectional shape may also be found adjacent the pummel region of the seat pan, so as to extend substantially around the front portion of the seat portion.

The rim adjacent the reinforced rear region may have a substantially triangular cross-section. It will be appreciated that the chair seat pan may comprise a peripheral rim of varying thickness and cross-sectional shape.

According to one embodiment of the invention the continuous upper surface is perforated. The perforations formed therein may extend across the entire of just part of the seat pan. The size of the perforations preferably vary across the surface of the seat pan. The perforations in the flexible regions of the seat pan may be larger than those in the rear reinforced region of the seat pan. The perforations may take any shape or form, and the shape may vary across the seat pan. The perforations may be provided in a predetermined pattern or randomly.

Preferably, the transition between the material thickness of the flexible regions and the material thickness of the rear reinforcing regions is gradually stepped. Preferably, the entire seat pan is integrally moulded resulting in a single piece of plastics material.

In an alternative embodiment, the reinforced rear region comprises a laminate of material bonded to the underside of the continuous upper surface. Preferably, the laminate is formed by the sequential application of a number of layers of material on the underside of the continuous upper surface. Preferably, the accumulative thickness of the laminate at the forward flexible regions is less than the cumulative thickness of the reinforced rear region. The plurality of layers of material provide an accumulative thickness of the seat pan which reduces toward the areas where flexibility is provided i.e. the accumulative thickness of the forward flexible regions is less than the cumulative thickness of the reinforced rear region.

The invention further provides a chair incorporating the seat pan of the invention as discussed above.

The term chair as used herein incorporates any type of seating, with or without a back support or backrest, including a stool. Wherein the chair comprises a frame, the seat pan is preferably height adjustable relative to the frame.

According to one embodiment of the invention, the chair further comprises a locking mechanism configured to lock the front flexible regions of the seat pan in at least one lower deformed position. Preferably, the locking mechanism is adapted to lock the front flexible regions independent of one another. The locking mechanisms used to provide such static deformation may vary, but such locking mechanisms should be devised so as to release the seat pan from such a deformation easily. Once the mechanism for locking the deformation of the seat pan has been deactivated, the seat pan should return to its original shape and should maintain its flexible region.

BRIEF DESCRIPTION OF THE DRAWINGS

Various embodiments of the present invention will now be described with reference to the accompanying figures in which.

DETAILED DESCRIPTION OF THE DRAWINGS

Figure 1:
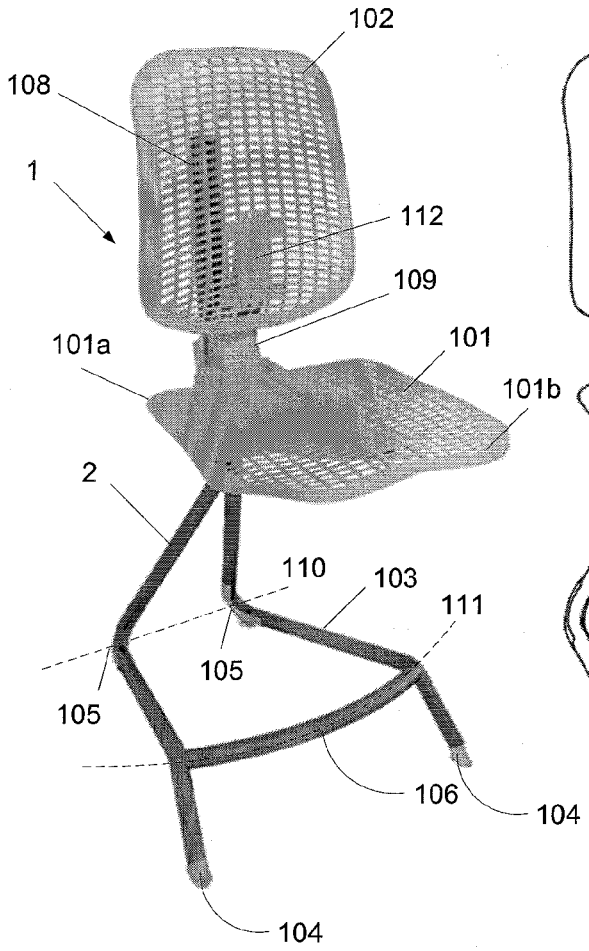
FIG. 1 shows a perspective view of a chair assembly according to one embodiment of the present invention.

The present invention discloses a seat pan for use with a chair assembly 1 such as that shown in FIG. 1. The supporting frame 2 of the chair assembly comprises an upper portion 108 and a lower portion 103, which in this embodiment is substantially triangular. By bending the lower portion 103 at the two points, 110 and 111, indicated by the dotted lines in FIG. 1, the supporting legs of the frame are formed.

The chair assembly contacts with the floor surface on which the chair assembly rests at two points at the rear 105 and two points at the front 104. A foot-rest 106 is provided which also provides additional structural support to the supporting frame 2 and also promotes a proper seating position by encouraging the seated user to sit further back on the chair seat.

The chair seat pan 101 is mounted on the underside to a seat supporting member which extends the from the rear portion of the seat pan 101*a* to the front portion of the seat pan 101*b*. The chair assembly shown in FIG. 1 also includes and a back support 102 which is attached to a back supporting member 112. Both the seat pan supporting member and the back supporting member are attached by a connective arrangement 109 to the supporting frame 2 of the chair assembly 1. It is envisaged within the present invention that this connective arrangement may comprise a pivoting mechanism which will allow the chair seat to pivot upwards towards the back support 102 to allow a folding arrangement which will allow for compact storage of a number of chairs. Additionally, it is envisaged that this connective arrangement 109 will be positioned to slide up and down the upper portion 108 of the supporting frame 2 to enable a variety of sitting positions for example at a standard height office desk or for a higher desk such as an architect style design table.

Figure 2:
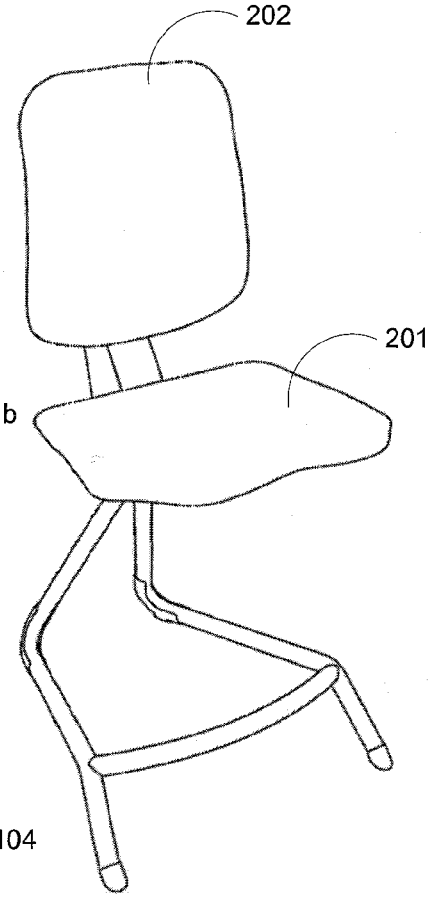
FIG. 2 shows a perspective view of a chair assembly according to a further embodiment of the present invention.

The chair assembly as described in FIGS. 1 and 2 can be used in a variety of seating arrangements. One possible arrangement involves the user seated at a standard desk such as an office desk or a school desk. A correct seating position in this case would involve the user sitting with the base of their spine as close as possible to the rear of the seat at position 101(*a*). In a second possible arrangement the user is seated at a high, possibly angled desk such as an architecture desk, primary school desk or graphics desk. A correct seating position in this case maintains the spine in a position similar to that which is achieved in a standing position.

In the embodiment shown in FIG. 1 both the chair seat pan 101 and the back support 102 are perforated. These perforations are further described in relation to FIGS. 5 and 6. A further embodiment of the present invention shown in FIG. 2 of the chair assembly with components similar to FIG. 1 but the chair seat pan 201 and back support 202 do not have these perforations.

It will be appreciated that although the chair seat pan of the present invention is preferably used with the frame of FIGS. 1 and 2 it is not limited for use with this frame structure. A chair incorporating the seat pan of the present invention may have an alternative frame structure.

Figure 3A:
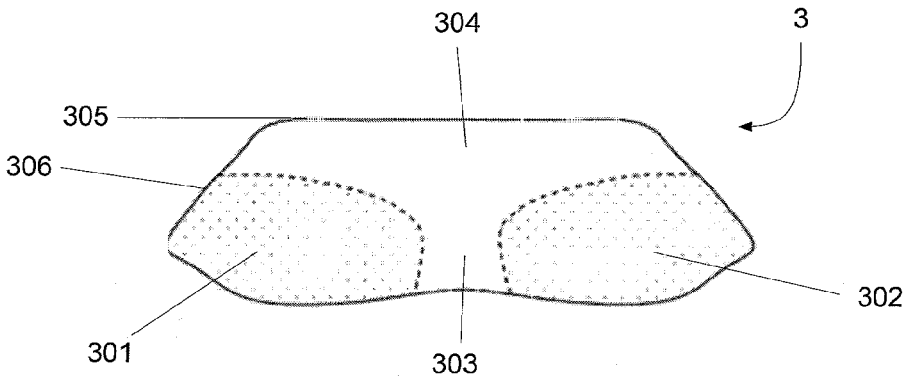
FIG. 3(*a*)-(*c*) show plan views of a seat pan according to one embodiment of the present invention.
Figure 3B:
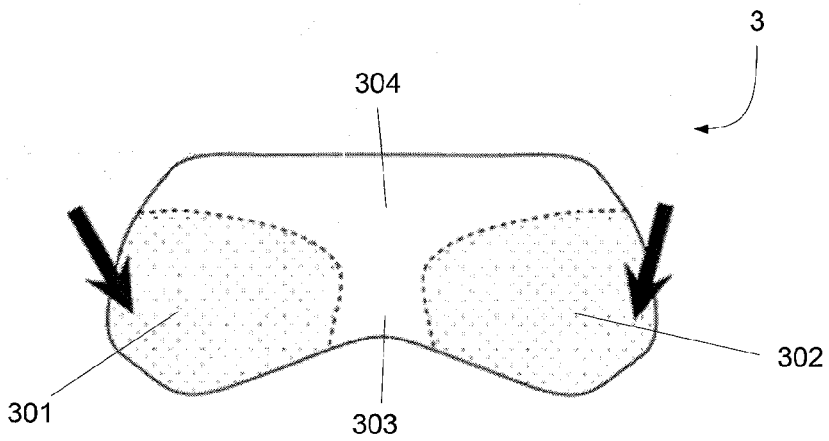

Various embodiments of chair seat pan according to the present invention are shown in FIGS. 3(*a*)-3(*c*). Each chair seat pan comprising a reinforced rear region 304 (also referred to herein as a rigid back portion), a reinforced pommel region 303 (also referred to herein as a rigid centre saddle portion), a pair of forward flexible regions 301, 302 which resiliently flex with respect to the reinforced regions 303, 304 under external pressure, and a continuous upper surface throughout the reinforced rear region 304, the reinforced pommel region 303, and the pair of flexible regions 301, 302 for supporting a user.

In FIGS. 3(*a*)-3(*c*) the forward flexible regions (also referred to herein as winged side portions) 301 and 302 are on opposing sides of the reinforced pommel region 303, also referred to herein as a centre saddle portion, the boundary of each side portion indicated by the dotted line in FIG. 3(*a*).

The seat pan as shown in FIGS. 3(*a*) to (*c*) is moulded in a "one part" construction by a single injection moulding process from a single material. The material used can be a polymer or composite. The seat pan can be injection or "gas-assist" injection moulded from a material such as polypropylene however any of a variety of materials which can be moulded to various thickness in any single injection moulding process could be used to manufacture the seat pan of the present invention.

In the embodiments shown in FIGS. 3(*a*) to (*c*) it is envisaged that when the seat pan is formed by an injection moulding process, the resulting seat pan 3 will be such that the rigid portions 304 and 303 will be of different thickness to the winged side portions 301 and 302. The winged side portions 301 and 302 are resiliently flexible in relation to the rigid portions, so that at rest i.e. (when no pressure is applied to the winged side portions 301 and 302) the seat pan will take the form shown in FIG. 3(*a*).

As described in relation to FIGS. 1 and 2, the seat pan can be used with a variety of desk types. When being used with an office desk or standard school desk, and the user is positioned correctly with the base of the users spine is as close as possible to the rear of the chair 305, the winged side portions of the chair will be maintained in the position as shown in FIG. 3(*a*). This provides optimal posture support and ergonomic support for the user. If the user moves forward in the seat pan in the direction of the arrow shown in FIG. 3(*a*) the winged side portions 301 and 302 flex in the direction shown by the arrows in FIG. 3(*b*) resulting in a flexed seat pan as shown in FIG. 3(*c*). The legs of the subject are directed apart and to the side of the centre saddle 303. The rigid centre saddle 302, which has a raised position when the winged side portions are flexed downwards as shown in FIGS. 3(*b*) and 3(*c*), encourages the user to re-adopt a seating position towards the rear of the chair which promotes good posture, thereby maintaining the spine in a suitable position. There is no inconvenient pinch effect when the subject is getting on or off the chair or the subject moves to this forward position as there is no divide between the winged side portions 301 and 302 and the centre saddle or the back portion.

In addition the winged side portions provide resistive feedback to the users thighs which in turn encourages a return to the correct seating position suitable for the desk being used. Both these features encourage the user to sit towards the back of the chair when using such a desk.

Figure 3C:
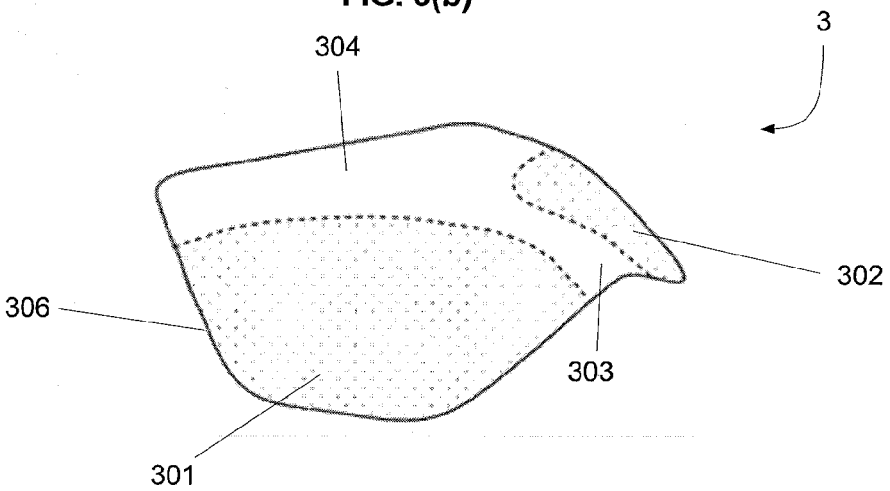

As mentioned above, the seat may be used with an angled desk such as that used by an architect or primary school student where the desk surface is typically higher than that of a standard desk. The seat pan of the present invention with its flexibility accommodates this seating position which maintains the spine in a position similar to that achieved when standing. In use with such a desk the seat pan would also be raised to a higher position. As the user perches on the front portion of the raised seat pan, support is provided by the centre saddle 303 as the winged side portions 301 and 302 flex downwards in a direction shown by the arrows in FIG. 3(*b*), about an axis defined by the dotted line in FIG. 3(*b*), maintaining the spine in a suitable position. This enables the user to sit forward on the centre saddle 303 and maintain an ergonomic and supported position at the raised desk. The embodiment of the design shown in FIG. 3*c* provides a comfortable working position for the user at a raised desk. The winged side portions 301 and 302 flex downwards under pressure from the users thighs and provide resistive feedback to the thighs. In addition the legs of the user are directed apart and to the side of the centre saddle 303 with no pinching effect as the seat pan is integrally moulded. A peripheral rim 306 surrounds the outer edges of the seat pan to provide additional comfort to the user and to enhance the flexibility of the chair.

Figure 5:
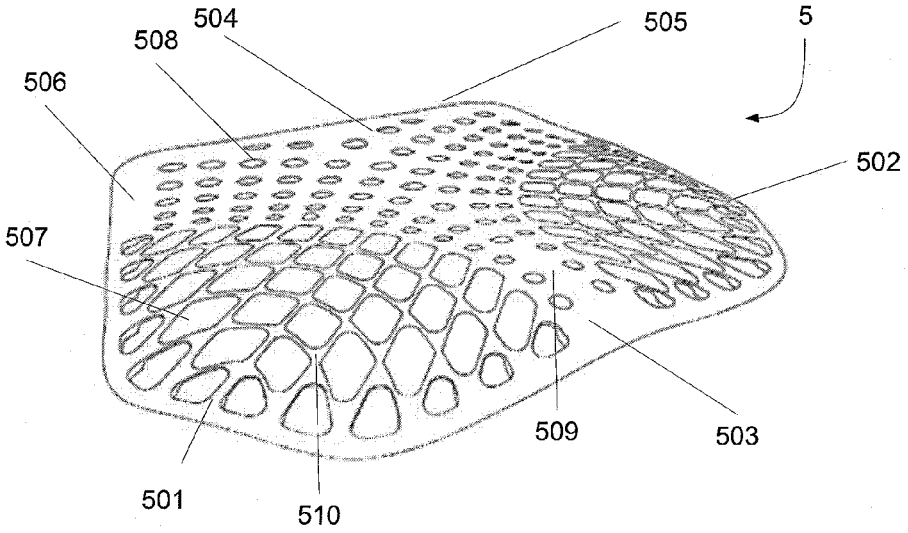
FIG. 5 shows a perspective view of one embodiment of a seat pan of the present invention where the seat pan is perforated with rhombic perforations.
Figure 6:
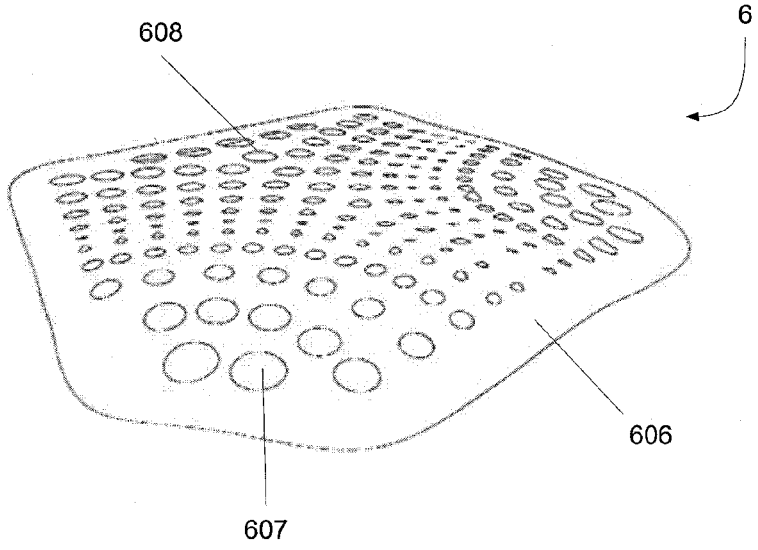
FIG. 6 shows a plan view of a further embodiment of the seat pan of the present invention where the seat pan is perforated with circular perforations.

Although the seat pan 3 shown in FIG. 3 *a* to *c* is shown solid, it will be appreciated that the seat pan structure described in relation to FIG. 3 can also apply to perforated seat pans as shown in FIG. 5 and FIG. 6.

Figure 4A:
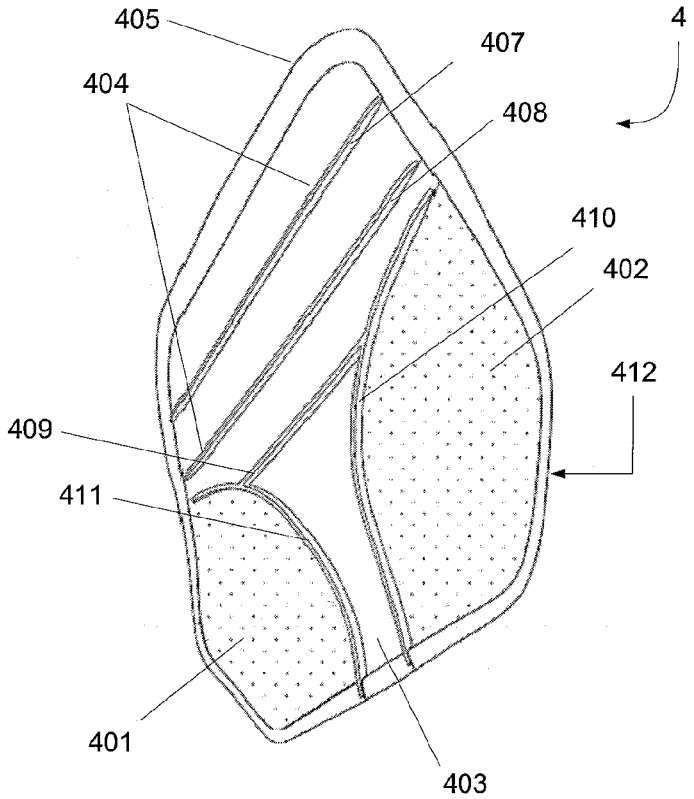
FIG. 4*a* shows a perspective view of the underside of the seat pan of FIGS. 3(*a*) to 3(*c*) showing the supporting rib structure of FIGS. 3(*a*) to 3(*c*).
Figure 4B:
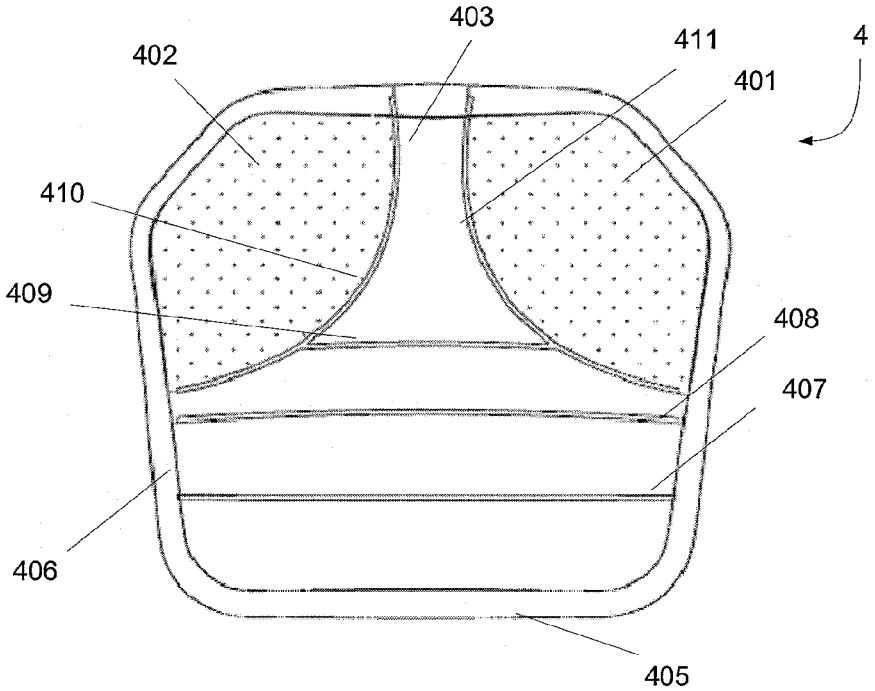
FIG. 4*b* shows a further perspective view of the underside of the seat pan with the supporting rib structure.

The chair seat pan primarily relies on a combination of material thickness in the main seat pan surface, along with the integration of structural ribs on the undercarriage. During the moulding process, supporting structural ribs 404 are formed on the underside of the chair seat pan as shown in FIGS. 4(*a*) and (*b*). The supporting structural ribs 407, 408 and 409, by their lateral orientation across the width of the seat pan in parallel with the back of the seat pan 405, provide additional support for the seated user. The moulded material is unable to flex as these supporting structural ribs help to maintain rigidity. These structural ribs 407, 408, 409, 410 and 411 extend perpendicularly from the underside 412 of the seat pan 4.

The seat pan and the structural ribs are moulded in a "one part" construction by a single injection moulding process from a single material.

On the flexible winged side portions 401 and 402, there are no moulded supporting structural ribs so these portions can flex when pressure is applied. The winged side portions will flex about an axis formed by the supporting structural ribs 410 and 411, which define the centre saddle 403.

In addition to the supporting rib structure, the flexibility of the chair is enhanced by using a honeycomb or mesh structure on the chair seat pan as shown in FIG. 5 and FIG. 6.

The seat pan 5 is formed using a mesh structure with a series of perforations in the moulded material. The rigid rear portion 504 and the rigid centre saddle 503 are formed from a mesh where the perforations in the moulded material 508 are significantly smaller than the perforations 507 in the winged side portions 501 and 502. In the rigid portions, the zone 509 between the perforations is large in contrast to the winged side portions where the zone 510 between the perforations is smaller.

In the rigid rear portion the combination of smaller holes and larger zones between the holes maintain the rigidity of the moulded material. However in the winged side portions 501 and 502 the mesh structure is not as strong, as the larger perforations allow increased flexibility in the moulded material. The perforations enhance the flexibility through removal of material, thus decreasing the rigidity of the seat pan. This enables the winged side portions to flex relative to the centre saddle 503 and the rear portion 504 as the mesh structure in the winged side portions will flex under applied user pressure. Additionally the orientation of the perforations in the winged side portions 501 and 502 is such that they are set in lines which contribute to flexing in a suitable direction.

As in FIG. 3(*b*) when pressure is applied to the winged side portions, these winged side portions flex in a downward direction. The orientation of these holes parallel to the line along which the winged side portions flex as shown by the dotted line in FIG. 5 allows for increased flexibility. In the mesh structure shown in FIG. 5 the perforations, 507 and 508 are rhombic, while FIG. 6 the perforations 608 and 607 are circular, however it will be appreciated that it is not limited to such shaped perforations.

Figures 7, 8:
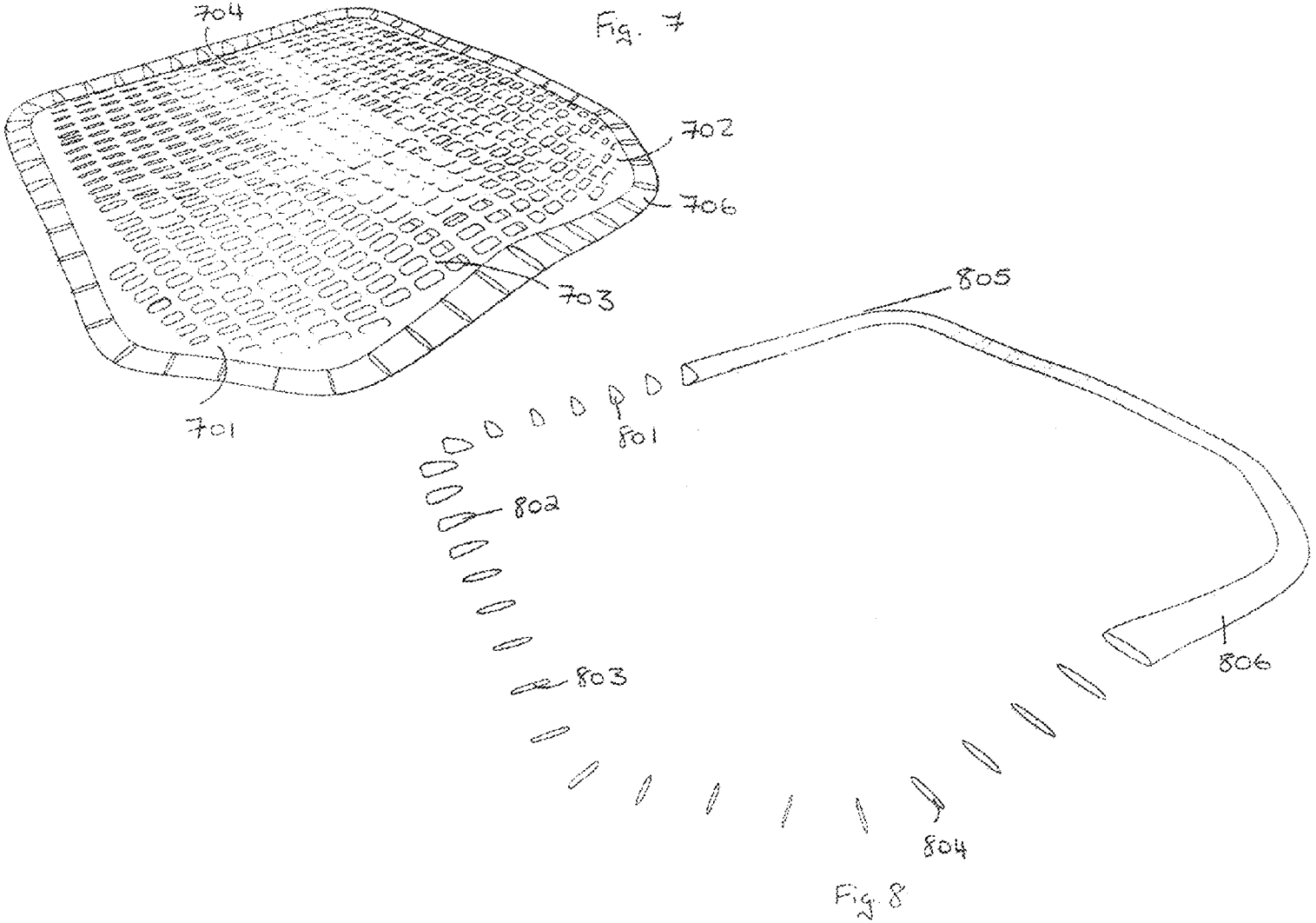
FIG. 7 shows a perspective view of a seat pan according to one embodiment of the present invention where the varying nature of the cross section of the rim is shown.
FIG. 8 shows a view of the seat pan of FIG. 7 where the varying nature of the cross section of the rim is shown.

The comfort of the user and the flexibility of the chair seat pan is also enhanced by a rim/frame shown in FIG. 7. The rim varies organically around the perimeter of the seat pan. Its composition is such that is stiffens the seat pan towards the rear of the seat pan and graduates to a thinner shape where the rim 706 surrounds the outer edges of the seat pan enclosing the outer edges of the flexible winged side portions 701 and 702 and also the centre saddle 703 and the rear portion 704. This rim 706 varies in cross section around the rim from where it is substantially triangular in cross section where it provides the rim of the outer edge of the rear portion 704, to substantially elliptical in cross section where it provides the rim of the winged side portions 701 and 702. The triangular cross section at the rear assists in maintaining a rigid rear portion. As the rim cross section varies from triangular to elliptical the flexibility of this rim increases, allowing the winged side portions 701 and 702 to flex when pressure is applied to these portions.

The varying cross section is further evident in FIG. 8. At the rear of the seat pan 806, a section 801 taken from the rim is substantially triangular in cross section. The triangular nature changes as can be seen from cross sections 802 and 804 where the sections become more elliptical.

In FIG. 8 the cross section 804 of the rim 806 at the centre saddle is also elliptical in cross section. This is to allow the rim to bend in response to pressure such that a smooth surface will rest against the users leg once they are in a seated position.

The rim itself also flexes to provide a smooth edge against the users legs thereby increasing the comfort for the user in a variety of seating positions.

In an alternative embodiment of the present invention, the continuous upper surface throughout the reinforced rear region of the seat pan acts as a base layer upon which a number of layers having sequentially reduced surface areas are applied. That is, a laminate is formed by the application of the several layers of material having sequentially reduced surface areas. When viewed face-on, this arrangement can be said to resemble the contour or gradient lines on a geographical map depicting the incline of a landmass, such as a hill or mountain, and is clearly illustrated in FIGS. 9*a* and 9*b* where the seat pan is generally indicated by reference numeral 9.

Figure 9B:
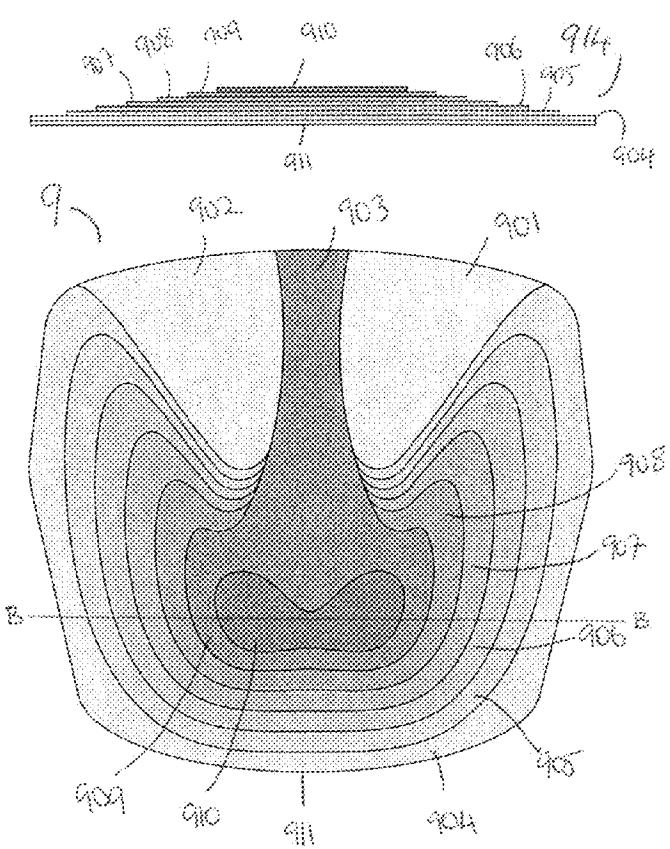
FIG. 9*b* shows a further perspective and front elevation view along line B-B of the underside of the seat pan as shown in FIG. 9*a*.
Figure 9A:
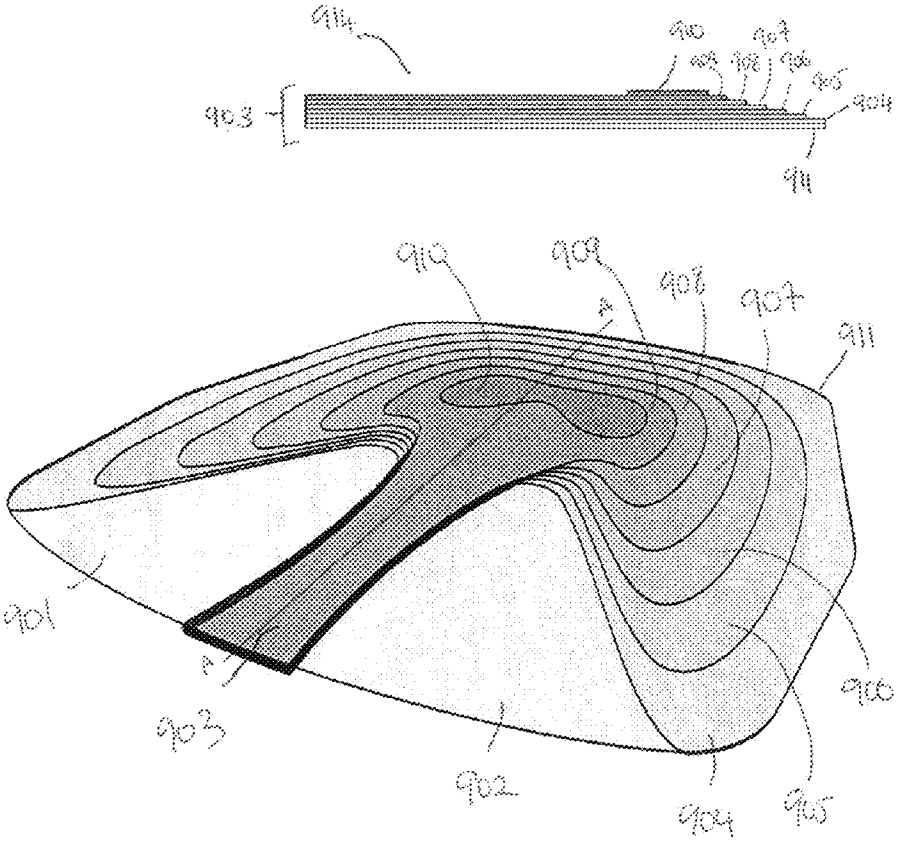
FIG. 9*a* shows a perspective and side elevation view along line A-A of the underside of the seat pan according to a further embodiment of the present invention where the seat pan comprises a plurality of layers providing a thickness that decreases towards the areas where flexibility is provided.

In the embodiment shown in FIGS. 9*a* and 9*b*, the seat pan 9 primarily relies on the sequential application of layers of material 904, 905, 906, 907, 908, 909, and 910 on the underside of seat pan 9 forming a laminate 914. The laminate 914 is understood in this embodiment to represent the sequential application of layers 904, 905, 906, 907, 908, 909, and 910. The layer 904 has the largest surface area while the layer 910 has the smallest surface area. The layers of material converge to form a centre saddle 903. By their layered orientation across the width of the rear of the seat pan, indicated by reference numeral 911, the laminate layers provide additional support for the seated user. The moulded material is unable to flex in this region as these layers of materials help to maintain rigidity of the seat pan.

The accumulative thickness of the seat pan 9 provided by the laminate 914 reduces towards the areas where flexibility is provided, i.e. the accumulative thickness of the flexible front regions 901 and 902 is less than the accumulative thickness of the layered materials forming the laminate 914 supporting the seat pan 9. In other words, on the flexible winged side portions 901 and 902, there are no additional layered materials so these portions can flex when pressure is applied. The winged side portions 901 and 902 will flex in a similar manner to how regions 301 and 302 flex in the embodiment shown in FIGS. 3(*a*)-3(*c*). Reference is made to the description above of this flexing motion.

In alternative embodiments (not shown) the seat pan may take the same external form as the seat pan shown in FIGS. 9*a* and 9*b* but be moulded in a "one part" construction by a single injection moulding process from a single material using a single cavity, that is, a single moulded piece.

As mentioned above, the seat may be used with an angled desk such as that used by an architect or primary school student where the desk surface is typically higher than that of a standard desk. The seat pan of the present invention with its flexibility accommodates this seating position which maintains the spine in a position similar to that achieved when standing. As the user perches on the front portion of the raised seat pan, and the winged side portions flex downwards maintaining the spine in a suitable position, the winged side portions may be locked into the deformed position by a locking mechanism provided within or on the seat pan. The type of locking mechanism used to provide such static deformation may vary, but such locking mechanisms should be devised so as to release the seat pan from such a deformation easily. Once the mechanism for locking the deformation of the seat pan has been deactivated, the seat pan should return to its original shape, while continuing to function with its flexibility. The locking mechanism should lock the winged portions in several lower deformed positions, each independent of the other. The locking mechanism allows alteration of the deformed sections of the flexible winged portions to suit subjects of varying height.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A chair seat pan, comprising:

a reinforced rear region rigid under external pressure;

a reinforced pommel region rigid under external pressure;

the reinforced pommel region being contiguous with the reinforced rear region to form an united reinforced area that is rigid under external pressure;

a pair of flexible, unreinforced and unsupported forward wing regions which resiliently bend relative to the reinforced pommel region under external pressure; and a continuous upper surface throughout the reinforced rear region, the reinforced pommel region, and the pair of flexible forward wing regions, for supporting a user.

2. The chair seat pan of claim 1 wherein at least the continuous upper surface is integrally molded resulting in a single piece of plastics material.

3. The chair seat pan of claim 1 wherein the flexible, unreinforced and unsupported forward wing regions have a material thickness less than a material thickness of the reinforced rear region.

4. The chair seat pan of claim 3 wherein a transition between the material thickness of the flexible, unreinforced and unsupported forward wing regions and the material thickness of the reinforced rear region is stepped.

5. The chair seat pan of claim 4, wherein the entire seat pan is integrally molded resulting in a single piece of plastics material.

6. The chair seat pan of claim 1 wherein the reinforced rear region comprises a plurality of reinforcing ribs.

7. The chair seat pan of claim 6 wherein the ribs are located on the underside of the chair seat pan.

8. The chair seat pan of claim 6 wherein the ribs are integrally molded on the underside of the chair seat pan.

9. The chair seat pan of claim 1 further comprising a peripheral rim of varying thickness.

10. The chair seat pan of claim 1 further comprising a peripheral rim of varying cross-sectional shape.

11. The chair seat pan of claim 10 wherein the rim adjacent the flexible, unreinforced and unsupported forward wing regions has a substantially elliptical cross-section.

12. The chair seat pan of claim 10 wherein the rim adjacent the reinforced rear region has a substantially triangular cross-section.

13. The chair seat pan of claim 1 further comprising a peripheral rim of varying thickness and cross-sectional shape.

14. The chair seat pan of claim 1 wherein the continuous upper surface is perforated.

15. The chair seat pan of claim 14 wherein the size of the perforations vary across the continuous upper surface of the seat pan.

16. The chair seat pan of claim 1 wherein the reinforced rear region comprises a laminate of material bonded to the underside of the continuous upper surface.

17. The chair seat pan of claim 16, wherein the laminate is formed by the sequential application of a number of layers of material on the underside of the continuous upper surface.

18. The chair seat pan of claim 1, wherein the continuous upper surface has no breaks or splits between the reinforced rear region, the reinforced pommel region and the pair of flexible, unreinforced and unsupported forward wing regions.

19. The chair seat pan of claim 1, wherein the continuous upper surface does not have at least one of (a) a slot, (b) a separation between the reinforced rear region, the reinforced pommel region and the pair of flexible, unreinforced and unsupported forward wing regions, and (c) an opening thereon.

20. The chair seat pan of claim 1, wherein the pair of flexible, unreinforced and unsupported forward wing regions which resiliently bend return substantially to a rest and non-bent position when no external pressure is supplied.

21. A chair comprising a chair seat pan comprising:

a reinforced rear region that is rigid under external pressure;

a reinforced pommel region that is rigid under external pressure;

the reinforced pommel region being contiguous with the reinforced rear region to form an united reinforced area that is rigid under external pressure;

a pair of flexible, unreinforced and unsupported forward wing regions which resiliently bend relative to the reinforced pommel region under external pressure; and a continuous upper surface throughout the reinforced rear region, the reinforced pommel region, and the pair of flexible forward wing regions, for supporting a user.

22. The chair of claim 21 further comprising a frame, wherein the seat pan is height adjustable relative to the frame.

23. The chair of claim 21, wherein each of the pair of flexible, unreinforced and unsupported forward wing regions resiliently bends about a curved bend line formed where one of the pair of flexible, unreinforced and unsupported forward wing regions meets the reinforced pommel region and the reinforced rear region.

24. A chair seat pan, comprising:

a reinforced and rigid rear region sized to support a user seated on the seat pan;

a centrally disposed reinforced and rigid pommel region;

said reinforced and rigid pommel region extending from the reinforced and rigid rear region toward a front portion of said seat pan;

a pair of flexible forward wing regions which, when supporting a user seated on the seat pan, resiliently bend along a curved bending line relative to:

the reinforced and rigid rear region; and the reinforced and rigid pommel region;

said pair of flexible forward wing regions which, when not supporting a user seated on the seat pan, assume an original unbent position; and an upper surface of the reinforced and rigid rear region, the reinforced and rigid pommel region, and the pair of flexible forward wing regions forming a continuous upper surface of the seat pan for supporting a user, wherein a surface area of the upper surface of each of the pair of flexible forward wing regions is greater than a surface area of the upper surface of the reinforced and rigid pommel region.

25. The chair seat pan of claim 24, wherein the seat pan is an integrally molded one piece member.

26. The chair seat pan of claim 24, wherein the seat pan has a front peripheral rim and the reinforced pommel region extends to the front peripheral rim.

27. The chair seat pan of claim 1, wherein:

the seat pan has a front end;

the reinforced pommel region extends to the front end; and each of the pair of flexible, unreinforced and unsupported forward wing regions resiliently bends about a curved bend zone formed where one of the pair of flexible, unreinforced and unsupported forward wing regions meets the reinforced pommel region and the reinforced rear region.

28. The chair of claim 1, wherein each of the pair of flexible, unreinforced and unsupported forward wing regions resiliently bends about a curved bend line formed where one of the pair of flexible, unreinforced and unsupported forward wing regions meets the reinforced pommel region and the reinforced rear region.

* * * * *